US007604508B1

(12) United States Patent
Harlan et al.

(10) Patent No.: US 7,604,508 B1
(45) Date of Patent: Oct. 20, 2009

(54) ELECTRICAL CONNECTOR UTILIZING CONTACT ARRAY

(75) Inventors: Tod M. Harlan, Mechanicsburg, PA (US); Terrance F. Little, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/154,832

(22) Filed: May 27, 2008

(51) Int. Cl.
*H01R 24/00* (2006.01)

(52) U.S. Cl. ..... 439/630

(58) Field of Classification Search ..... 439/630, 439/62, 66

See application file for complete search history.

(56) References Cited

U.S. PATENT DOCUMENTS 4,676,579 A * 6/1987 Ting ..... 439/825
4,678,250 A * 7/1987 Romine et al. ..... 439/83
5,000,694 A * 3/1991 Komatsu ..... 439/260
5,775,949 A * 7/1998 Bricaud et al. ..... 439/630
5,820,389 A * 10/1998 Hashiguchi ..... 439/66
6,083,022 A 7/2000 Walkup
6,231,395 B1 * 5/2001 Odic ..... 439/630
6,447,304 B1 * 9/2002 Korsunsky et al. ..... 439/66
7,252,563 B2 8/2007 Lotes

FOREIGN PATENT DOCUMENTS

CN 2932712 Y 8/2007

* cited by examiner

*Primary Examiner*—Phuong K Dinh
(74) *Attorney, Agent, or Firm*—Andrew C. Cheng; Wei Te Chung; Ming Chieh Chang

(57) ABSTRACT

An electrical connector (100) for electrically connecting a substrate (4) to a printed circuit board (5) comprises an insulative housing (2) and a plurality of contacts (3) arranged in matrix. The insulative housing defines a receiving slot (21) extending along a front-to-back direction from front surface thereof, a plurality of rows of through passages (23) arranged along a lateral direction of the insulative housing and each through passage extending substantially along an angular axis of both the front-to-back direction and lateral direction to communicate with the receiving slot. Through passages of the same row are spaced arranged along the front-to-back direction. The matrix of contacts is respectively arranged in said through passages of the insulative housing in an interference capacity with said receiving slot. Each contact comprises an upper compliant connecting portion (32) protruding into the receiving slot adapted for being compressed by said substrate to form electrical connection, a middle supporting portion (30, 33) received in the through passage to retain the contact in the insulative housing and a lower elastic connecting portion (31) exposed beyond corresponding through passage adapted for electrically connecting to said printed circuit board.

14 Claims, 10 Drawing Sheets

ELECTRICAL CONNECTOR UTILIZING CONTACT ARRAY

BACKGROUND OF THE INVENTION

1. Field of the Invention

The present invention relates to an electrical connector, more particularly to an electrical connector for receiving a card type connector, such as an FFC (Flexible Flat Cable) connector.

2. Description of Related Art

LGA-LGA (Land Grid Array) connectors are widely used to achieve electrical connection between a CPU (Central Processing Unit) to a PCB (Printed Circuit Board). Such connector usually comprises a frame-shape insulative housing and a plurality of contacts arranged as an array in an insulative housing. Each contact comprises a compressible upper connecting portion exposed beyond an upper surface of the insulative housing for compliant contact of the CPU pads, a media retention portion interferentially engaging with the insulative housing, and a lower connecting portion exposed beyond a lower surface of the insulative housing for compliant contact of the PCB pads. Such type connector is convenient to form reliable electrical connection between the CPU and the PCB and is easy to form fine pitch which meets current trends of miniature. U.S. Pat. No. 6,083,022 also discloses a connection between the FPC and a daughter board via the LGA type contacts.

The present invention provides a new design of this type of connector which is utilized for new use.

BRIEF SUMMARY OF THE INVENTION

Accordingly, an object of the present invention is to provide a electrical connector utilizing contact array.

In order to achieve the above-mentioned object, an electrical connector adapted for electrically connecting a removable substrate to a printed circuit board comprises an insulative housing and a plurality of contacts arranged in a matrix. The insulative housing defines a receiving slot extending along a front-to-back direction from front surface thereof, a plurality of rows of through passages arranged along a lateral direction of the insulative housing and each through passage extending substantially along an angular axis of both of the front-to-back direction and lateral direction to communicate with the receiving slot. Through passages of the same row are spaced and arranged along the front-to-back direction. The matrix of contacts are respectively arranged in said through passages of the insulative housing, in an interference capacity with said receiving slot. Each contact comprises an upper connecting portion protruding into the receiving slot adapted for being compressed by said removable substrate entering into said receiving slot, to form electrical connection, a middle supporting portion received in the through passage to retain the contact in the insulative housing and a lower contacting portion exposed beyond corresponding through passage adapted for electrically connecting to said printed circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
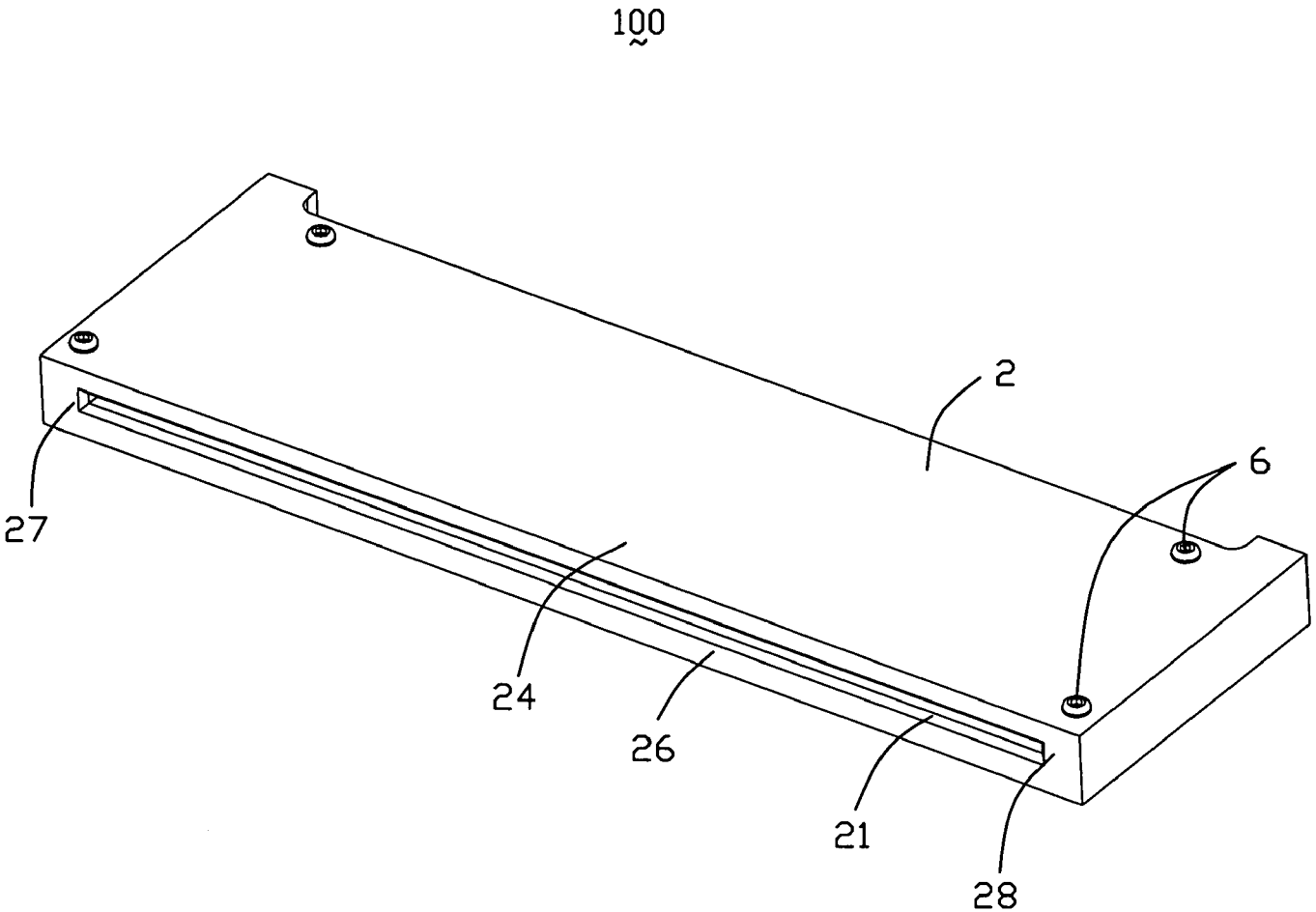
FIG. 1 is an assembled, perspective view of an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 3:
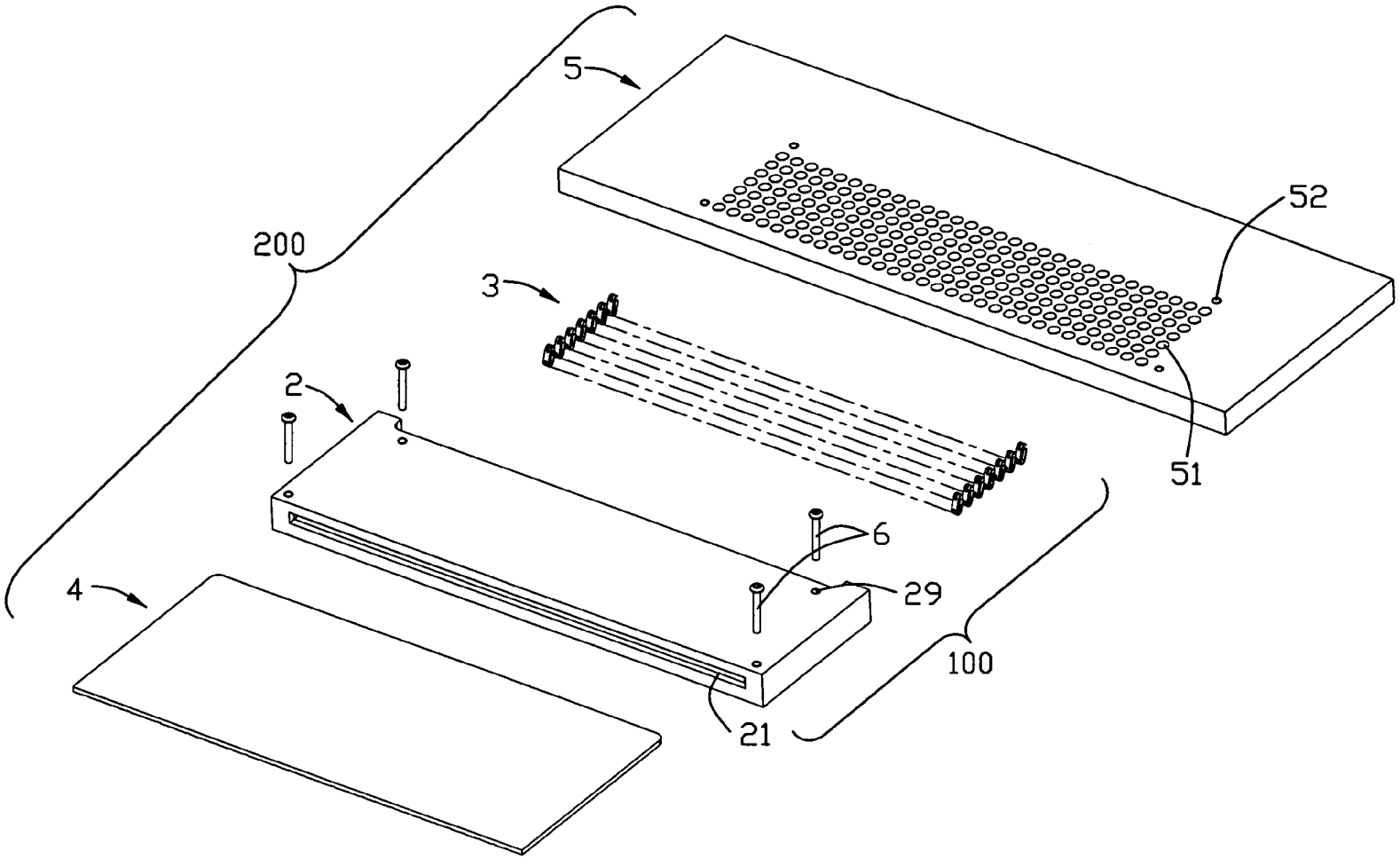
FIG. 3 is an exploded, perspective view of a connector assembly.
Figure 4:
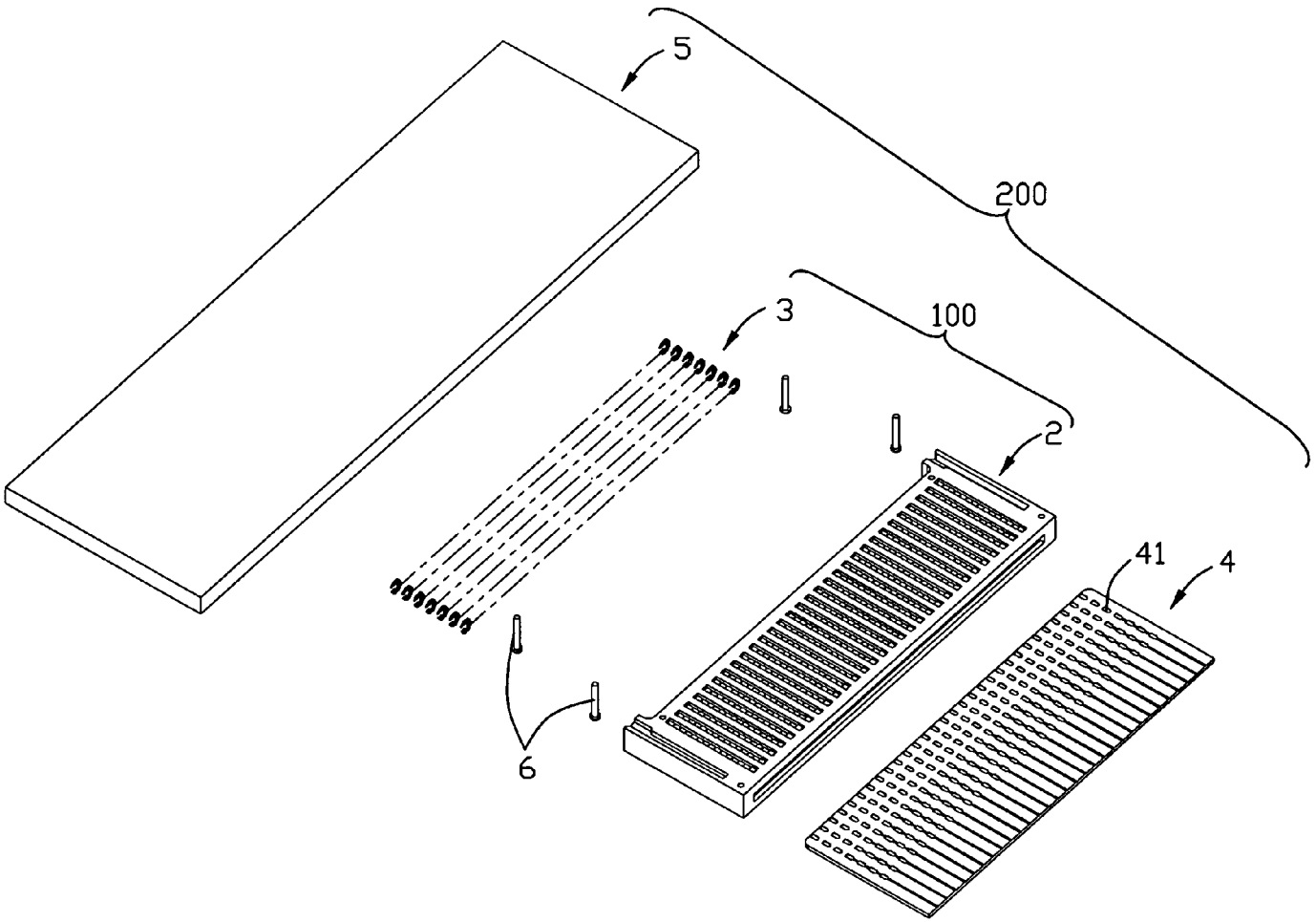
FIG. 4 is a view similar to FIG. 3, but viewed from a different aspect.
Figure 5:
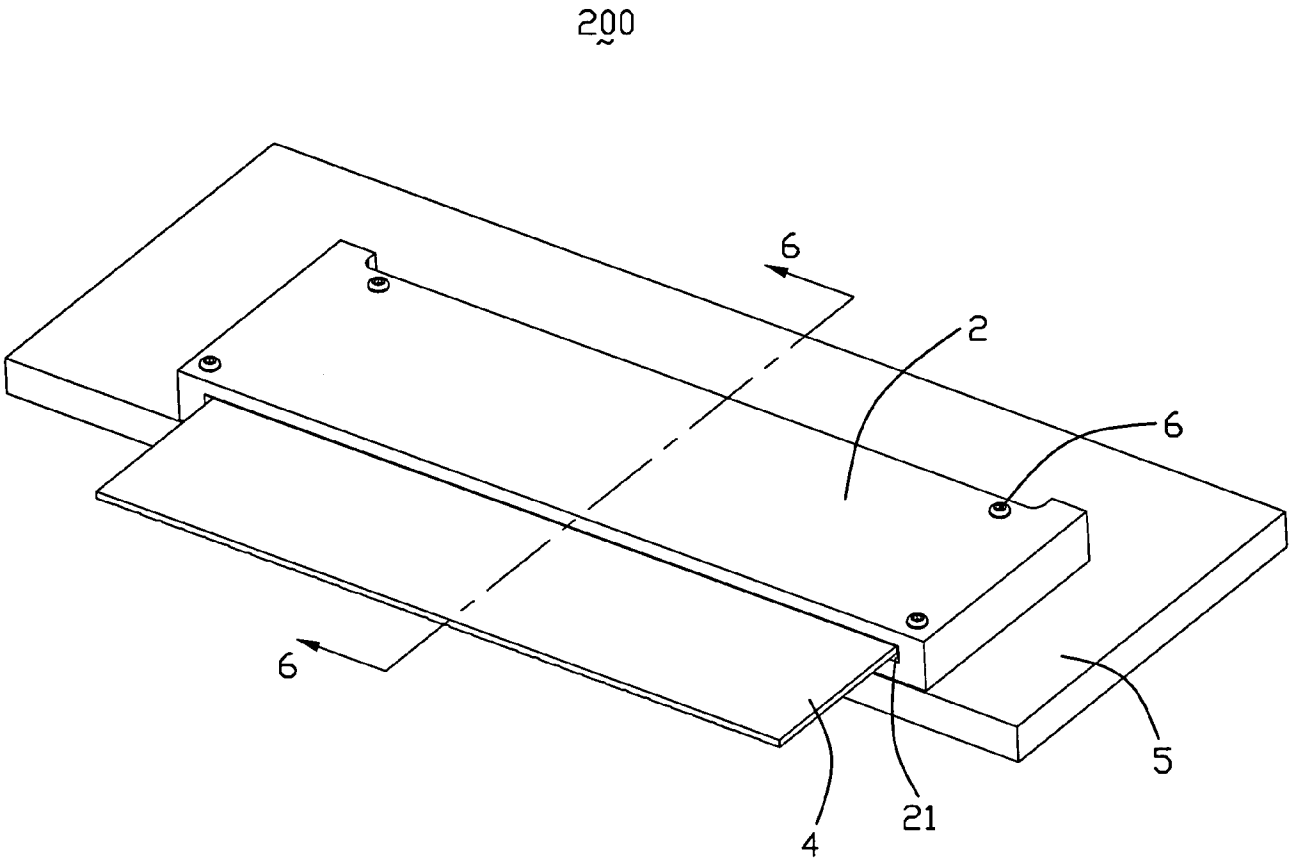
FIG. 5 is an assembled view of FIG. 3.
Figure 6:
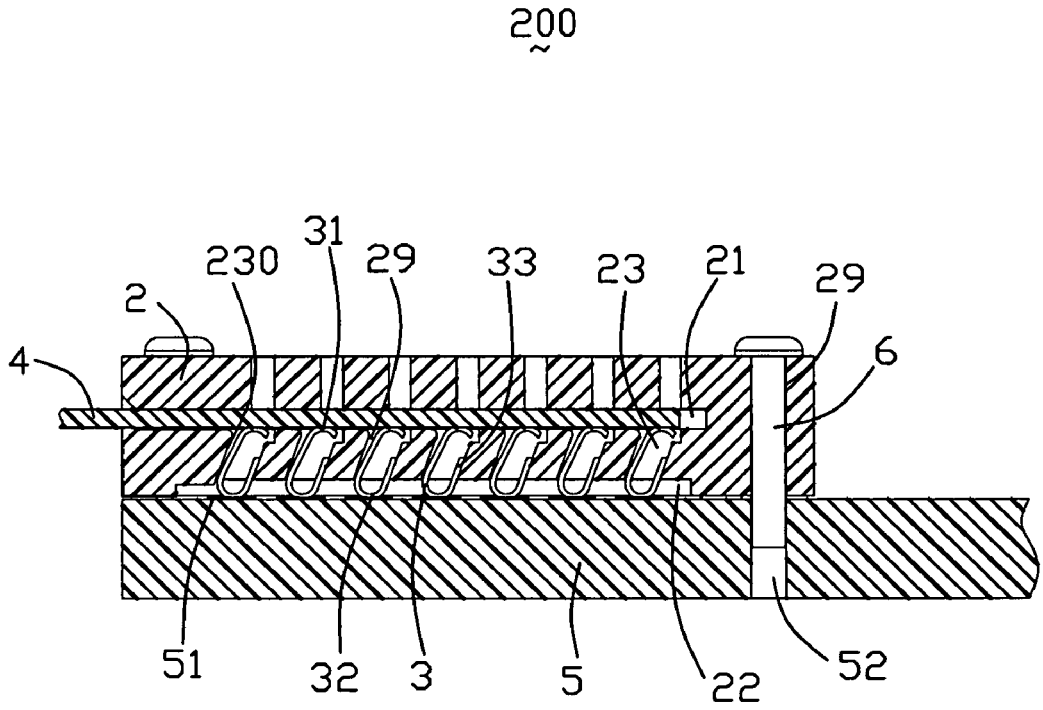
FIG. 6 is a cross-section view taken along line 6-6 of FIG. 5.
Figure 7:
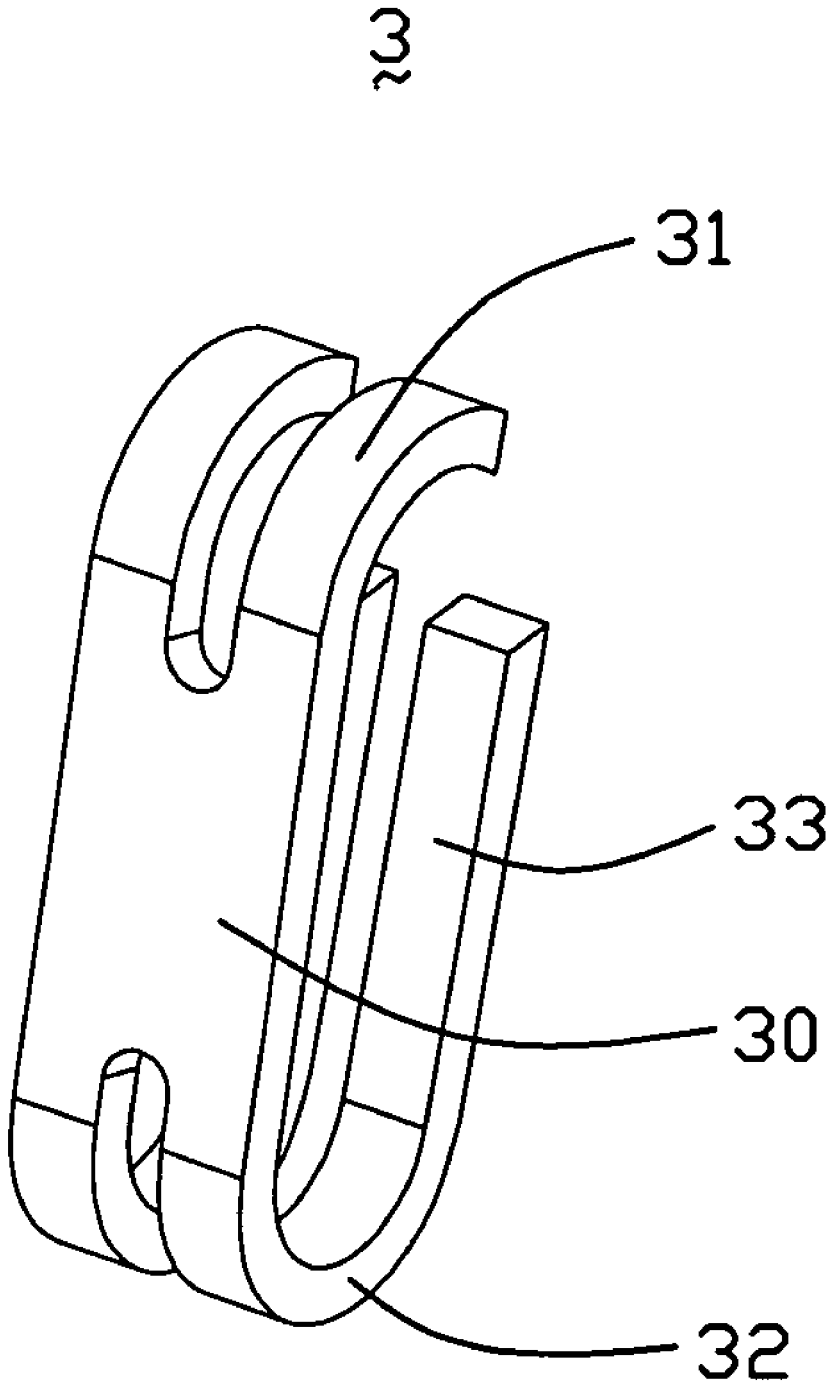
FIG. 7 is an enlarged, perspective view of a contact of the electrical connector.
Figure 9:
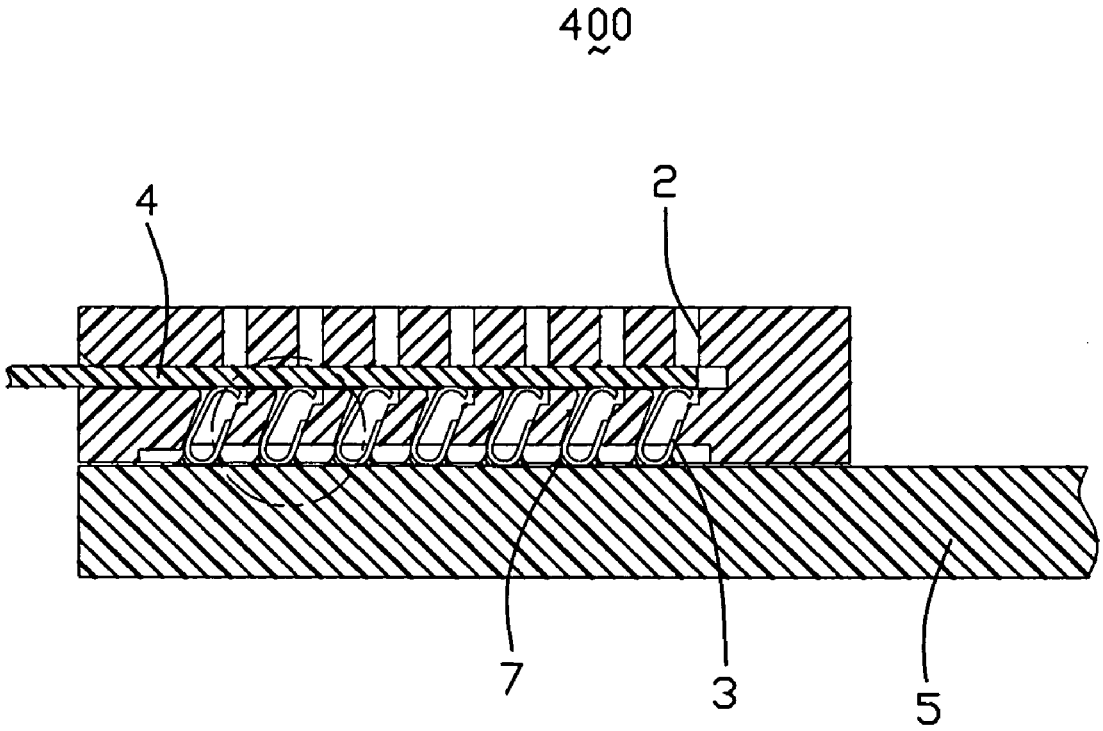
FIG. 9 is a cross-section view shown an electrical connector in accordance with the second embodiment of the present invention.

Please refer to FIGS. 1-4 in conjunction with FIGS. 5-7, an electrical connector 100 in accordance with the first embodiment of the present invention is a low-profile, right-angle card-edge style connector and comprises an insulative housing 2 and a plurality of contacts 3 received in the insulative housing 2. FIGS. 5 and 6 depict the electrical connector 100 assembled to a Printed Circuit Board (PCB) 5 via four mounting hardwares 6 suitable for compression attachment. This enables compression of contacts 3 to achieve electrical connection without soldering. FIG. 9 is an alternate form of attachment to the Printed Circuit Board (PCB) 5 through surface mount soldering. Both methods are capable of receiving the substrate 4, to form a connector assembly 400 in accordance with another embodiment of the present invention.

Figure 2:
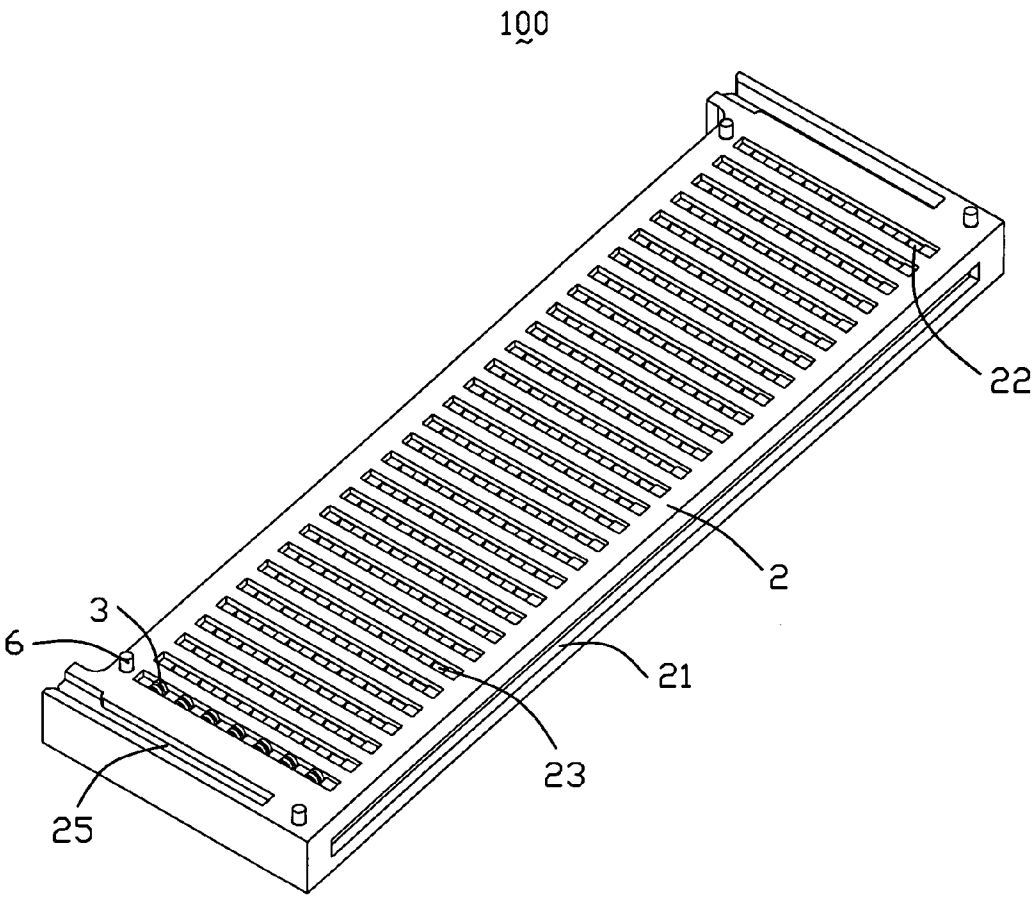
FIG. 2 is a view similar to FIG. 1, but viewed from a different aspect.

Please refer to FIGS. 1-2 in conjunction with FIGS. 3-7, the insulative housing 2 of the electrical connector 100 is a rectangular, elongated body and defines a central receiving slot 21 recessed rearward a certain distance from a front surface thereof to separate the insulative housing 2 into opposite elongate upper and lower walls 24, 26 and opposite short left and right lateral walls 27, 28. Particularly referring to FIG. 2, a plurality of rectangular recesses 22, each extending mainly along front-to-back direction, recess upwardly from a bottom surface of the insulative housing 2 a certain distance and are arranged in one row along lengthwise direction. In each recess 22, a plurality of through passages 23 are defined and arranged angularly through the lower wall 26 to communicate with the recess 22 and the receiving slot 21. The angular through passages 23 arranged in the same recess 22 are spaced and arranged in a row. Multiple rows can enable an array pattern. A pair of narrow slits 25 are defined in the lateral walls 27, 28 and communicate with the bottom surface for interferentially receiving a pair of board locks (not shown) to secure the insulative housing 2 to the PCB 5. In addition, the through passage 23 is angular, that is to say, the opposite inner sidewalls 230 of the through passage 23 are angular. In addition, the insulative housing defines an opening 29 to permit the mounting hardware 6 extending therethrough.

Referring to FIGS. 3-4 in conjunction with FIGS. 6-7, the contacts 3 are arranged in matrix corresponding to the through slots 23 of the insulative housing 2. Each contact 3 comprises a pair of opposite supporting portions 30, 33 respectively served as a movable arm and an immovable arm, a curved contacting portion 31 extending upwardly from the movable supporting portion 30 and curved toward the immovable supporting portion 33, and a curved connecting portion 32 connecting bottom edges of the supporting portions 30, 33. The contacting portion 31, the connecting portion 32 and the supporting portion 33 are bi-furcated to form a dual-beam structure that enhances compliancy and reliability of signal transmission.

Figure 8:
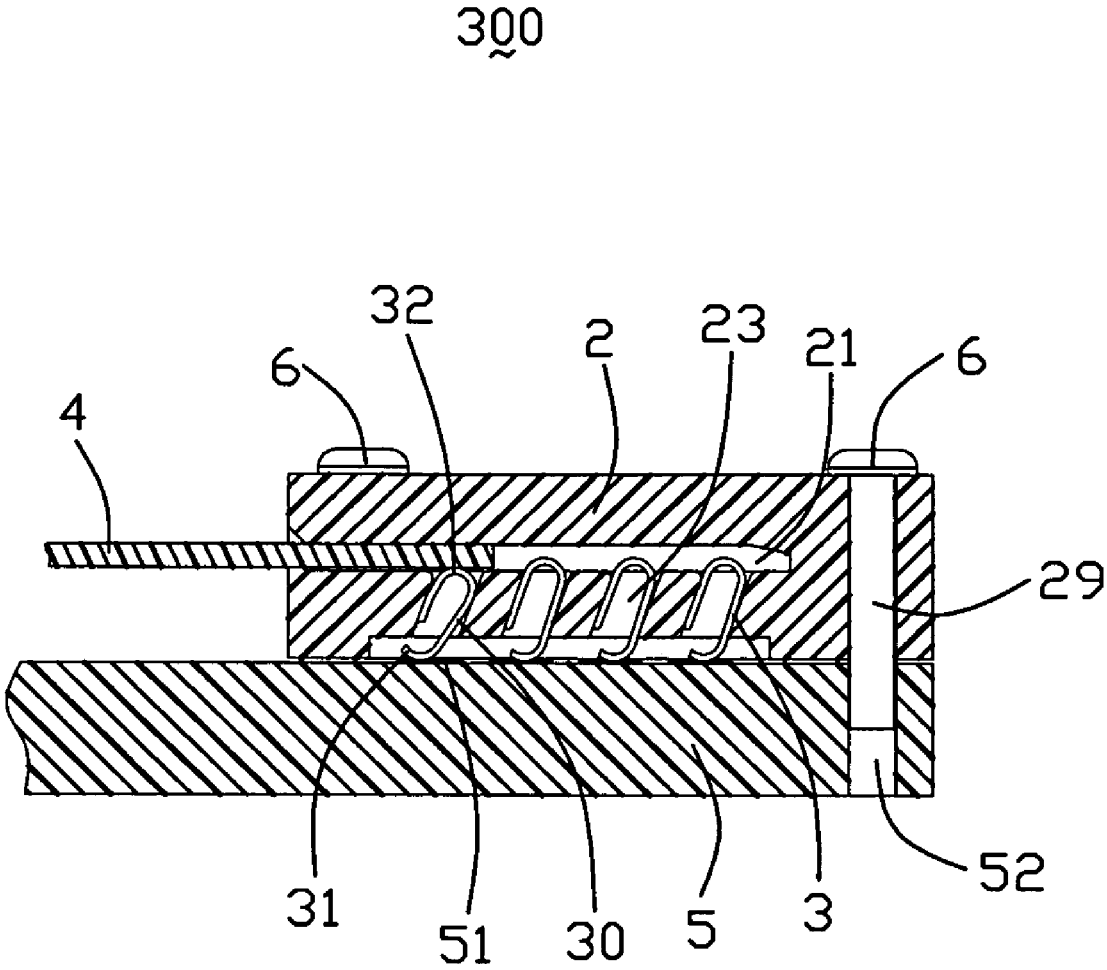
FIG. 8 is a cross-section view shown an electrical connector in accordance with the second embodiment of the present invention.

In assembly, the contacts 3 are assembled into the insulative housing 2 from the bottom surface of the insulative housing 2 with the pair of supporting portions 30, 33 respectively and with flexibility abut against the inclined inner sidewalls 230 of the through passages 23 to pre-load and aid in retaining the contact 3 in the insulative housing 2, the connecting portions 32 partially exposed into the receiving slot 21, and the contacting portions 31 exposed into the recesses 22 and beyond the bottom surface of the insulative housing 2. This is an electrical connector 300 (FIG. 8) as the first embodiment of the present invention.

Figure 10:
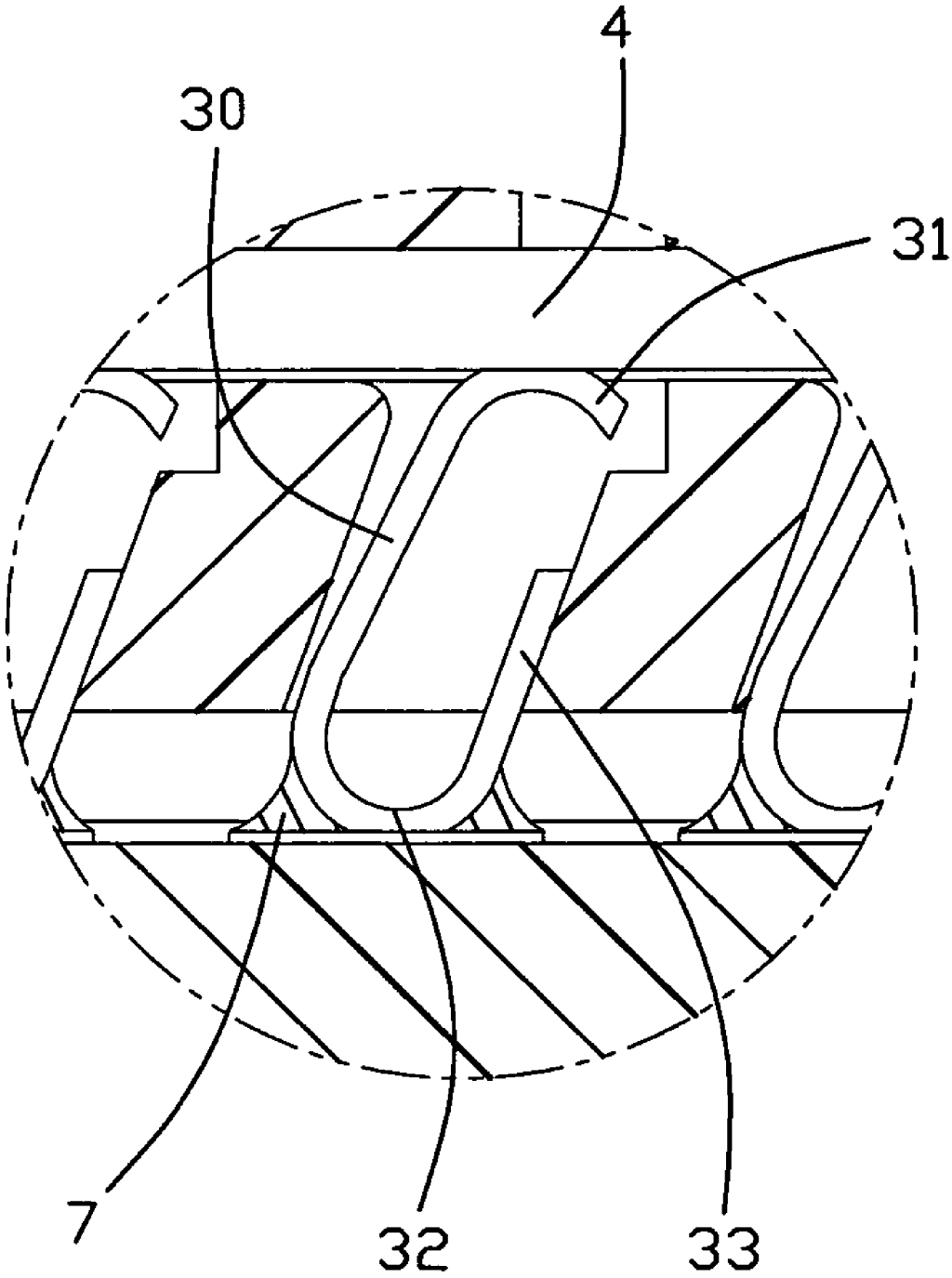
FIG. 10 is an enlarged view of a circled section in FIG. 9.

The PCB 5 is a flat board arranged with a plurality of conductive pads 51 in a matrix corresponding to the contacts 3 and an opening 52 to receive the mounting hardware 6. The conductive pad 51 is a round shape and depends on mounting style: compression or solderable, the pads 51 can be Gold plated or Tin plated. If compression mount, then hardware 6 is used to hold the electrical connector down and provide the mechanical means to compress the contacts and thereby make electrical connection to gold plated pads. If solderable, direct attach via soldering (FIG. 9, labeled as 7) thereto or surface mounting thereto via solder balls (not shown) to form electrical connection between the electrical connector 400 (FIGS. 9-10) of the present invention with the PCB 5.

The substrate 4 is an FFC (Flat Flexible cable) in the preferred embodiment. However, it also can be a FPC (Flat Printed Cable, Flexible Printed Circuit) or a thin layer PCB. The FFC substrate 4 is arranged with a plurality of electrical pads 41 in matrix corresponding to the contacts 3 on its rear edge thereof. When the rear edge of the FFC substrate 4 is inserted into the receiving slot 21 of the insulative housing 2, the connecting portions 32 and the movable supporting portions 30 are deflected toward the immovable supporting portions 33 until the free end of the contacting portion 31 resides within the rectangular recesses 22, thus, the movable supporting portion 30 forms a wedge-shape space 29 together with the inner sidewall 230 of the through passage 23 against which the supporting portion 30 abuts. Finally, when the FFC substrate 4 inserts to its final position, the connecting portions 32 contact with corresponding electrical pads 41. Thus, the FFC /FPC substrate 4 is retained to the insulative housing 2 via contact normal force.

Please refer to FIG. 7, another embodiment of the contact 3 is to assemble contact 3 upside-down into the through passage 23 of the insulative housing 2. When the substrate 4 is inserted into the receiving slot 21, the substrate 4 exerts a downward force to the contacting portion 31, originally being the connecting portion 32, which causes the contacting portion and it's movable supporting portion to deflect and wipe/slide on the conductive pads 51 of the PCB 5 to form the electrical connection, either. This is an electrical connector 200 in accordance with the second embodiment of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector assembly comprising:

a printed circuit board having a plurality of conductive pads on an upper surface thereof;

a substantially rectangular insulating housing retainably seated upon said upper surface, said housing defining a plurality of passageways extending between opposite middle and bottom faces of said housing and through the bottom face;

a plurality of resilient contacts disposed in the corresponding passageways, respectively;

a receiving slot defined in the housing and communicating with an exterior, through an opening in a front face of the housing, in a direction parallel to said printed circuit board; and each of said contacts defining opposite upper and bottom ends, said bottom ends downwardly extending beyond the bottom faces, and said upper end upwardly extending above the middle face and into the receiving slot; wherein the bottom end mechanically and electrically engages the corresponding conductive pad, and the upper end is adapted to be mechanically and electrically connected to a thin substrate which is received in the receiving slot wherein each of said contacts defines a loop-like capsular shape snugly and compliantly received in the corresponding passageway with two opposite side arms of the capsular shape abutting against corresponding inner faces of the corresponding passageway when the thin substrate has not been inserted into the receiving slot and said contact is in a relaxed manner.

2. The assembly as claimed in claim 1, wherein the passageway extends in an oblique direction with regard to the printed circuit board.

3. The assembly as claimed in claim 2, wherein said oblique direction extending from the bottom face toward the receiving slot, is directed away from the opening of said receiving slot.

4. The assembly as claimed in claim 1, wherein said housing defines a common recess to communicate all the passageways together around said bottom face.

5. The assembly as claimed in claim 1, wherein said capsular shape defines with a notch in a loop configuration.

6. The assembly as claimed in claim 5, wherein said notch is located in one of two opposite side arms of said capsular shape.

7. The assembly as claimed in claim 6, wherein said notch is located closer to the receiving slot.

8. The assembly as claimed in claim 7, wherein the side arm without the notch thereof, is deflected toward the side arm with the notch thereof, when said contact is operated with the inserted thin substrate.

9. The assembly as claimed in claim 6, wherein the inner face, which the side arm having the notch thereof abuts against, upwardly faces to the receiving slot.

10. An electrical connector for interconnecting a mother board and a substrate comprising:

a substantially rectangular insulating housing seated upon the mother board and defining a receiving slot extending from a front face of the housing and in a horizontal direction parallel to the mother board and a plurality of through passages communicating with the slot, the substrate being edgewise inserted into the receiving slot; and a plurality of contacts mounted within the through passages respectively, each contact comprising an upper contact portion extending into the receiving slot to engage an electrical pad on the substrate, a bottom contact portion extending out of the through passage to engage an electrical pad on the mother board, a movable supporting arm connecting the upper contact portion and the bottom contact portion and abutting against one inner wall of the through passage, and an immovable supporting portion extending upward from the bottom contact portion with a tip end abutting against an opposite inner wall of the through passage.

11. The electrical connector as claimed in claim 10, further comprising a plurality of mounting hardwares passing through corners of the insulative housing and fastening the housing onto the mother board.

12. The electrical connector as claimed in claim 10, wherein the contacts in a same front-to-back row communicate with a common recess formed at the bottom of the insulative housing.

13. The electrical connector as claimed in claim 10, wherein the through passage extends in an oblique direction with regard to the mother board.

14. The electrical connector as claimed in claim 13, wherein said oblique direction is directed away from an opening of said receiving slot

* * * * *